United States Patent [19]

McClanahan et al.

[11] 4,361,444

[45] Nov. 30, 1982

[54] SPRAY STRIP PICKLING OF UPRIGHT MATERIAL

[75] Inventors: Buford A. McClanahan; Herb W. Udolf, both of Albany; Charles R. Zander, Scio; Robert W. Thresher, Albany, all of Oreg.

[73] Assignee: Teledyne Industries, Inc., Los Angeles, Calif.

[21] Appl. No.: 245,659

[22] Filed: Mar. 20, 1981

Related U.S. Application Data

[63] Continuation of Ser. No. 79,066, Sep. 26, 1979, abandoned.

[51] Int. Cl.[3] ..... B08B 3/08; C23G 1/02

[52] U.S. Cl. ..... 134/3; 134/9; 134/18; 134/28; 134/41

[58] Field of Search ..... 134/15, 28, 3, 64 R, 134/9, 18, 41

[56] References Cited

U.S. PATENT DOCUMENTS

| | | | |
|---|---|---|---|
| 2,359,088 | 9/1944 | Croft | 134/28 X |
| 3,125,474 | 3/1964 | Watkins et al. | 134/28 X |
| 3,460,549 | 8/1969 | Webb | 134/15 X |
| 3,543,775 | 12/1970 | Bodnar | 134/15 X |

*Primary Examiner*—Evan K. Lawrence

*Attorney, Agent, or Firm*—Shoemaker and Mattare, Ltd.

[57] ABSTRACT

A method and setup for pickling strip material which is oriented in a widthwise upright position. The method includes spraying rinse water onto the material, gauging the thickness of the material, then alternately spraying pickling acid onto the material and wiping that acid off of the material a plurality of times, then rinsing the material soon after the last acid spraying step to remove acid and drying the material. The setup and method can be used to pickle either material having an undetermined length, or strips of prescribed lengths.

10 Claims, 12 Drawing Figures

SPRAY STRIP PICKLING OF UPRIGHT MATERIAL

This is a continuation, of application Ser. No. 079,066, filed Sept. 26, 1979, abandoned.

BACKGROUND OF THE INVENTION

The present invention relates in general to pickling of materials, and, more particularly, to pickling of strip materials.

Known methods used for pickling strip material use dip steps. Thus, materials are placed on edge in hanger brackets and lowered by crane into an acid solution. The material is then water rinsed. The primary disadvantage of this known method is associated with the time delay in transferring the material from an acid tank to a rinse tank. During this transfer time, the acid continues to react with the material, and cause a pickle "burn" effect on the surface of the material. The "burn" effect causes a blotchy appearance and uneven removal of material.

Known methods of pickling strip material have been carried out using a series of tanks oriented in horizontal positions. Some of the tanks contain acid, and others contain water. The material to be pickled is immersed in the acid tanks and water tanks by means of rollers. This method of pickling has the disadvantage that bubbles form during pickling which cause a rough, non-uniform surface finish.

Thus, in the past few years, strip pickling has developed into a trouble-prone operation. The operation itself requires the close coordination of several operators. The speed of the strip is hand controlled, and the gauging of the material into and out of the pickle tanks is all done with hand-held micrometers. The pickle finish of the final product has, therefore, been highly variable in quality.

Thus, there is need for a system and a method of pickling strip material which does not cause pickle "burn" of the material or produce a rough, uneven surface finish.

SUMMARY OF THE INVENTION

The method and apparatus embodying the teachings of the present invention pickles strip material which is oriented in an upright position, that is, with the widthwise faces thereof extending in a vertical direction.

The vertical strip and coil pickling apparatus of the present disclosure comprises a pneumatic upender, a vertical variable speed driven feed roll case feeding the material between rinse and acid spray units through a ventilated polypropylene tank. Post-rinse and air drying is performed on the strip in a simultaneous fashion after pickling, and the processed strip is then fed onto a pneumatic downender. Vertical coil pickling varies only from the above process by feeding the coil material from a vertical payoff unit onto a hydraulically operated vertical coiler unit. In the preferred embodiment, the material passes through three independently operated acid spray units at feed speeds from about zero to about thirty feet per minute, thus regulating the material removal rate from about 0.0002 inches to about 0.0015 inches per pass. The gauging of the material is performed by ultrasonic transducers located at the infeed end of the process tank and continuously gauging the material and displaying the thickness on a digital readout located at an operator console. Similarly comprised, but located between the last post rinse unit and an air knife, is a gauging unit displaying the final thickness of the acid pickled material on a second digital readout unit at the operator console. Preferably, all processing material contacting components are designed and made of non-marking and acid proof plastics.

Sheet and strip material are roller fed by variable speed power rollers in a vertical position between (1) water pre-rinse; (2) acid spray; and (3) water post-rinse spray nozzle manifolds. Following the water-acid-water spray is a dryer system comprised of air knives which removes the rinse water from the material surface to prevent staining and to facilitate further processing of the material.

The entire water and acid spray system is totally encased in a plastic and fiberglass cabinet which is compartmented to separate the water rinse and acid spray steps and systems. At the top and center of this cabinet is an exhaust system which is blower driven to remove fumes. The pickling rate is controlled basically by the acid strength and composition and the rate of material travel through the acid spray.

Lengths of strip material are loaded onto a pneumatically activated horizontal platform. The platform is then activated to raise the material 90 degrees to the vertical position, that is, a position with the widthwise dimension oriented essentially vertically. At this point, rollers are activated to feed the material into and through the spray compartment and dryer system. After exiting the dryer, the material is returned to the horizontal, or recumbent, position with the widthwise faces thereof oriented to be essentially horizontal, by a roller platform for further processing.

Strip material that is coiled is processed by mounting the material on a vertical in-feed coiler and recoiling that material after processing onto a vertical take-up coiler. The coilers are designed to tension the material for straight line passage through the processing compartment. In addition, the take-up coiler is designed to automatically compensate rotational speed to maintain consistent linear travel as the coil diameter increases.

The preferred embodiment has three acid pickle tanks. These tanks are temperature controlled by a system of coiled plastic tubing within the acid tanks. Water is circulated through this tubing to maintain the desired acid temperature. Initially, the pickle acid is heated by warm water circulation. As the pickle acid begins to develop heat from the pickling reaction, cooling water is circulated as required to maintain satisfactory acid temperature.

The spray pickling method and system of the present disclosure provides excellent control over all the conditions involved in pickling. By spraying the acid, the amount of acid and the spray pattern, angle and velocity can be precisely controlled. Control of the material travel speed as well as acid strength and temperature enables pickling of the material at controlled removal rates with uniformity over the length and width of the material.

Spray rinsing assists in removing the acid more completely than is possible with known methods, and minimizes blotchy surface effects resulting from residual acid.

The blower knife drying system dries the material quickly and uniformly and prevents water spotting of the material.

The spray pickling system and method of the present disclosure has at least the following characteristics:

high speed (up to 30 feet per minute); temperature controlled acid; automatic strip removal from acid on system failure for several reasons, such as panic stop by operator, under gauge sheet by a predetermined amount, or loss of strip motion; variable speed control, either manual or automatic based on metal removal rate; strip rinse in a fixer solution soon after pickling with little or no exposure to air; circulation of all fluid; and strip drying prior to coiling.

Using the teachings of the present disclosure, a high gloss mirror-like finish can be obtained on flat surfaces of Zircaloy (a trademark for a Zirconium alloy). For a discussion of Zircaloys, see "The Development of the Zircaloys" by Stanley Kass, dated Oct. 1962, presented at USAEC Symposium on Zirconium Alloy Development, Nov. 12–14, 1962, and U.S. Pat. No. 2,772,964.

The process embodying the teachings of the present invention includes the steps of: orienting a strip of material to have the two widthwise faces thereof in an essentially upright position; moving said strip material in a straight line at an essentially constant rate which rate falls in a range of between 0–30 feet per minute along the length dimension of such strip; wiping said strip material; spraying water at an angle of about 10 degrees from normal with respect to the material upright faces to pre-rinse both said upright faces with water; ultrasonically gauging the thickness of the strip material; spraying pickling acid onto both said pre-rinsed upright faces at an angle of about 20 degrees with respect to the material upright faces, said acid spraying step including three successive treatments of acid comprising spraying acid a first time onto said upright faces, removing at least some of said pickling acid from both said faces by simultaneously wiping both said faces immediately after said acid spraying step, spraying acid a second time onto both said wiped faces, and removing at least some of said pickling acid from both said faces by simultaneously wiping both said faces immediately after said second acid spraying step, spraying acid a third time on both said wiped faces, removing at least some of said pickling acid from both said faces by simultaneously wiping both said faces immediately after said third acid spraying step; performing a post-rinse to remove acid from both of the faces by spraying both said upright faces with water after wiping said acid therefrom in the last-mentioned wiping step, said spraying occurring as soon as possible after the last wiping step so that post-rinse of said strip material occurs with essentially no exposure thereof to air between acid application and water rinse; ultrasonically gauging the thickness of the strip material after said post-rinse spraying step; drying said post-rinsed upright faces with air, said drying occurring quickly and uniformly to essentially prevent water spotting of the strip Zircaloy; tensioning said strip material so that straight line passage through said rinsing, pickling and drying steps is maintained; and storing the material after said drying step.

OBJECTS OF THE INVENTION

It is a main object of the present invention to pickle a strip material without producing a pickle "burn".

It is another object of the present invention to pickle a strip material to produce a smooth, even surface.

It is yet another object of the present invention to pickle a strip material which has been oriented in a widthwise upright orientation.

It is still another object of the present invention to pickle a strip of Zircaloy in a widthwise upright orientation using spraying steps.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1A:
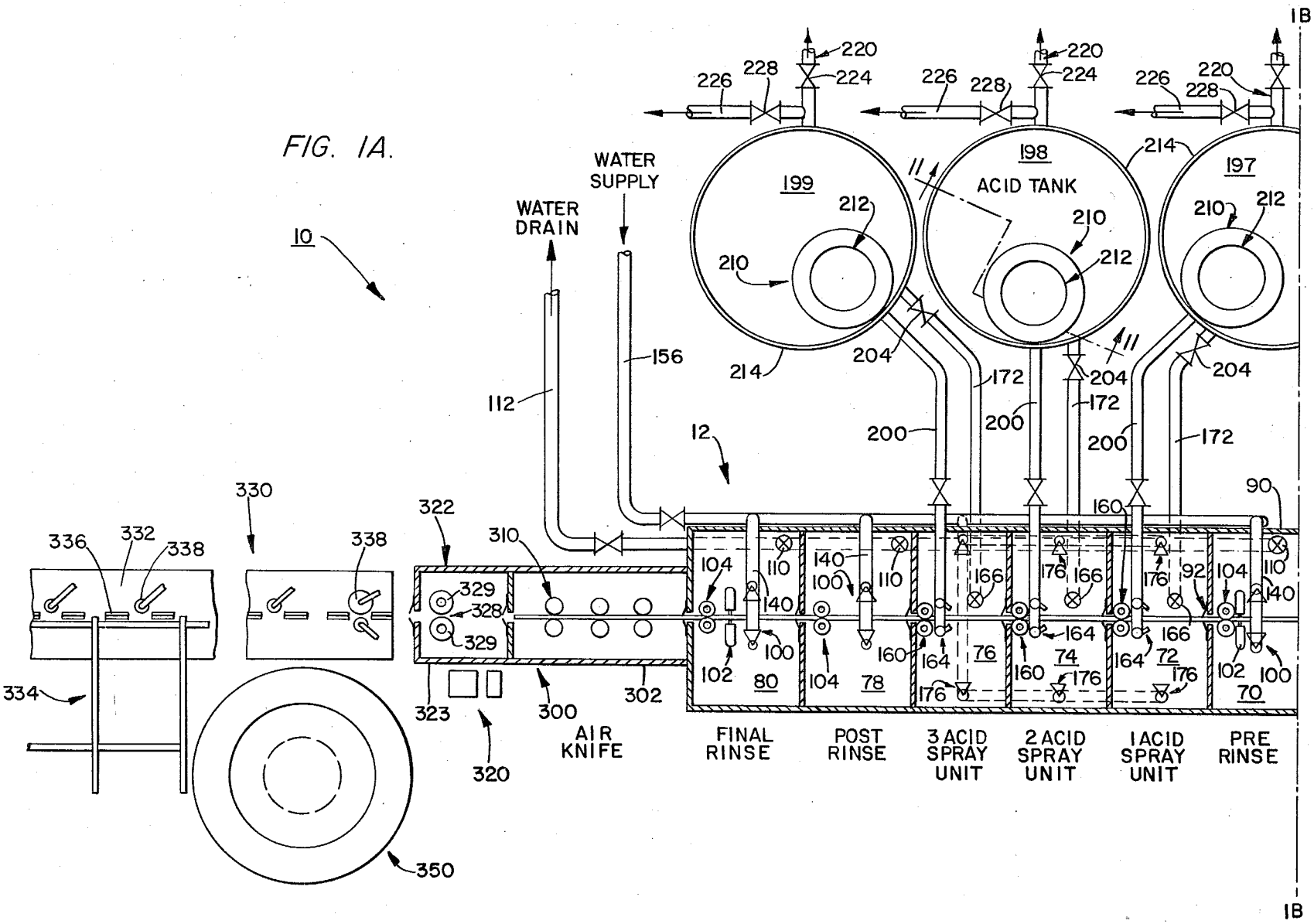
FIGS. 1A and 1B are plan views of a strip pickling setup embodying the teachings of the present invention.
Figure 1B:
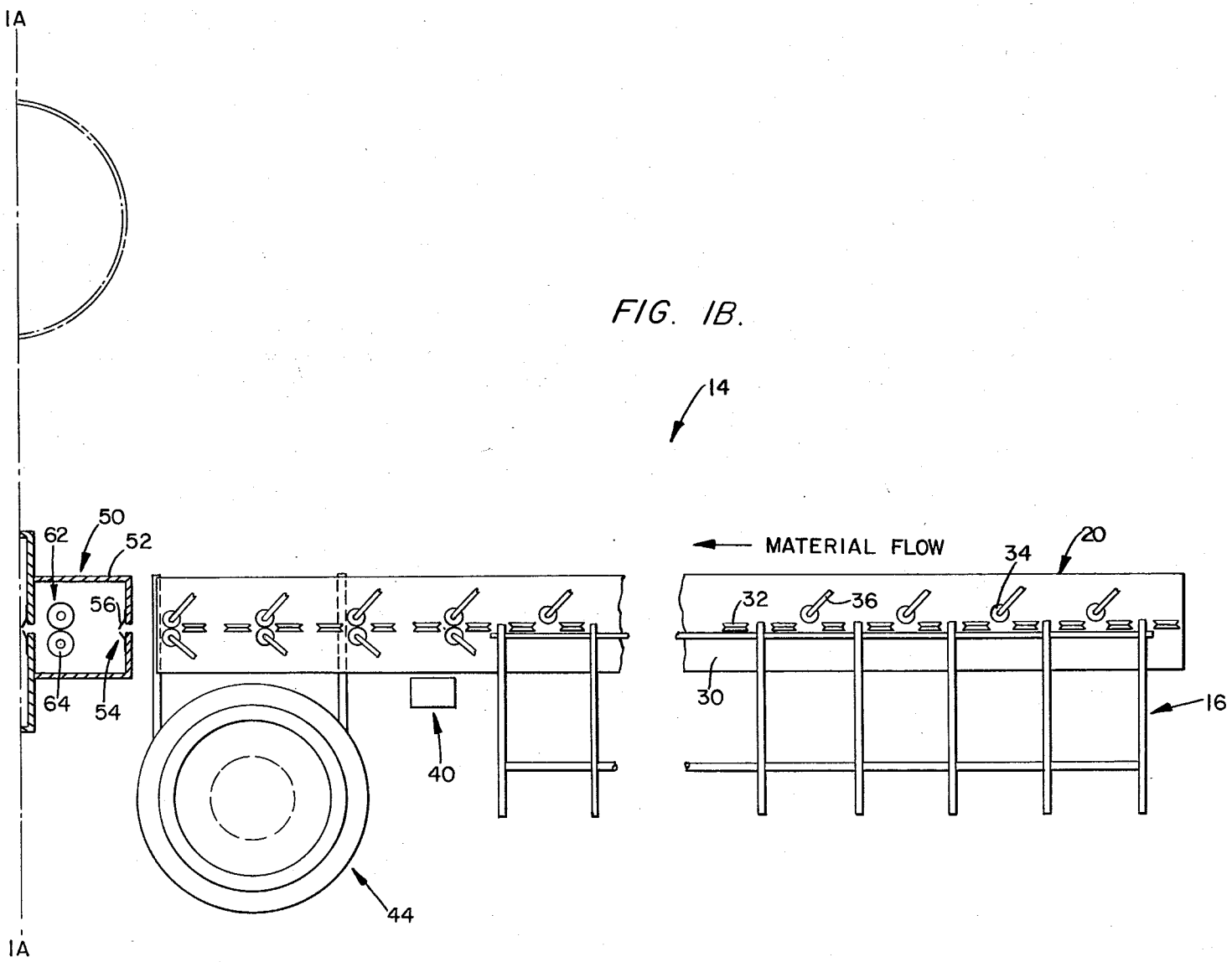

Shown in FIGS. 1A and 1B is a spray pickling system 10 for spray pickling material which has been oriented in an upright position. The material, such as zirconium or Zircaloy, is supplied to the pickling system in strips of indeterminate lengths, or in strips of discrete lengths, and moves through a processing section or spray section 12 in an upright orientation, that is, the width dimension of a strip of material is oriented to be essentially upright, as will be discussed in greater detail below.

Figure 2:
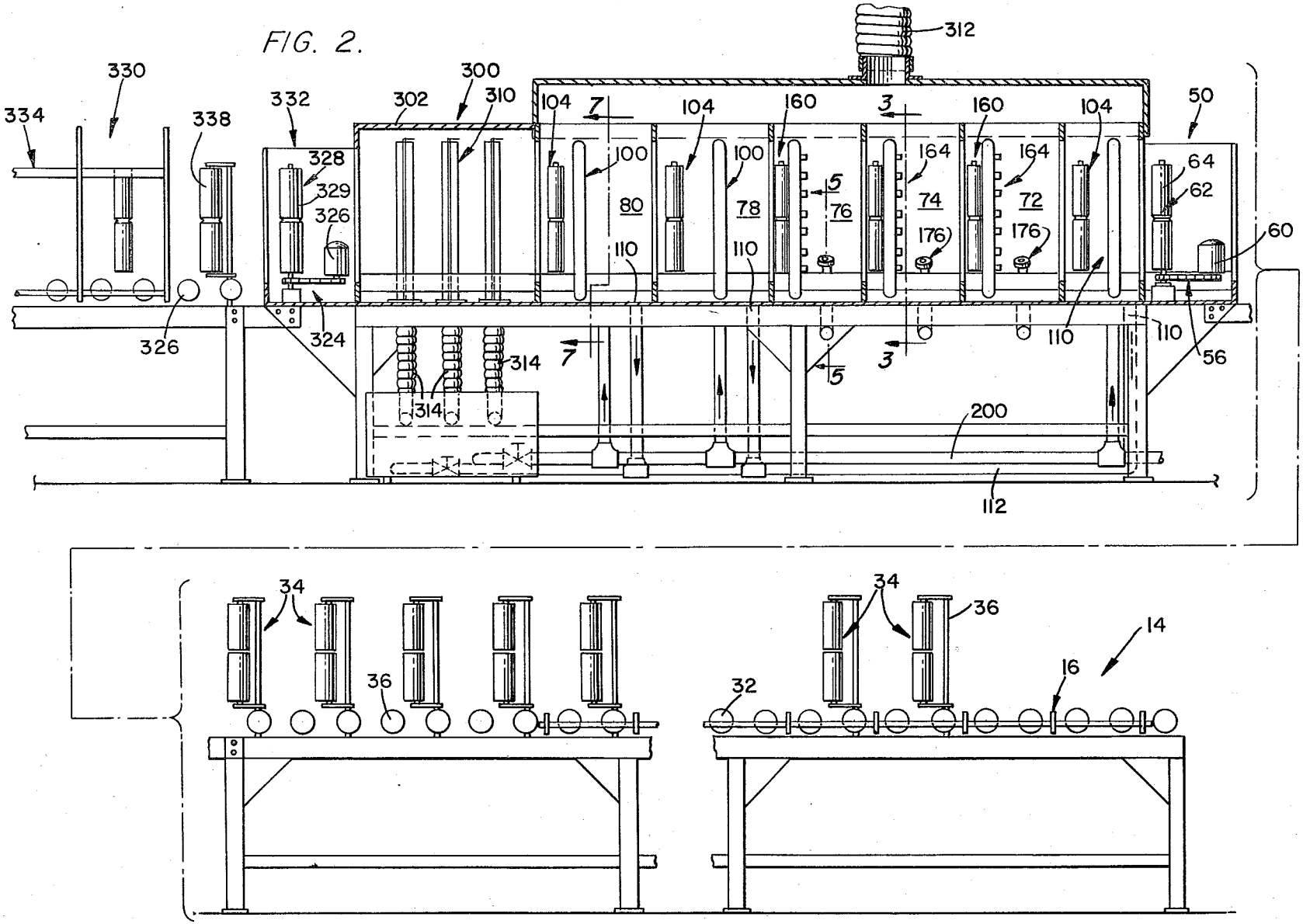
FIG. 2 is an elevation view of the strip pickling setup embodying the teachings of the present invention.

The pickling system 10 includes an entrance apron 14 which has a pneumatic upender or loader 16, and a material conveying system 20 located upstream of the spray section 12. The loading apron 14 is used with strips of material having prescribed lengths. It is here noted that flow terms such as "upstream", and the like, are taken with reference to direction of material flow as indicated in FIG. 1B. The loader 16 includes a material upender and is shown in FIGS. 1B and 2 to be in a down position. The preferred form of the loader is pneumatically actuated, and the loader raises the material from a widthwise horizontal orientation into a widthwise upright orientation.

The conveying system 20 includes a mounting table 30 on which are mounted a plurality of rolls 32 and 34. The rolls 34 are elongated and are oriented to be vertically disposed for contacting the widthwise face of the material being processed, and the rolls 32 contact the bottom edge of that material and are thus V-shaped as indicated in FIG. 1B. Mounting brackets 36 support the rolls 34. A control means 40 is operably connected to the elements of the system entrance section for controlling flow of the material into the spray section 12.

A vertical payoff unit, or uncoiler 44, is located adjacent the loading apron for providing material to be pickled. The uncoiler 44 is used in conjunction with materials having undetermined length, that is, a strip of material of indefinite length. The uncoiler 44 is shown in two positions in FIG. 1B, an operative position closely adjacent guide rollers 32, and an inoperative position spaced from these rollers. The inoperative position is used when strips of material are being treated. The operative position for uncoiler 44 is indicated in phantom lines in FIG. 1B; whereas the inoperative position therefor is indicated in solid lines.

A power drive assembly 50 is located between the spray section 12 and the apron 14 and includes a housing 52 having an entrance gateway 54 defined therein. A pair of flaps 56 span the entrance gateway and contact the widthwise faces of the strip material passing into the spray section from the apron 14. It is noted that flaps are located in covering relationship with each compartment gateway to be described hereinafter and serve to wipe material passing between the various compartments and to fluidly seal each compartment from the adjacent compartment. As shown in FIG. 2, the power drive assembly includes a mounting platform 56 on which a motor 60 and a drive roll assembly 62 are mounted. The drive roll assembly includes a pair of drive rolls 64 located on each side of the material flow path as shown in FIG. 1B.

The spray section includes a plurality of compartments placed serially along the material flow path. The compartments are identified in FIG. 1A to include a pre-rinse compartment 70 wherein rinsing material, such as water, is sprayed onto material, three pickling acid spray units 72, 74 and 76 wherein pickling material, such as pickling acid, is sprayed onto the material, a post-rinse compartment 78 and a final rinse compartment 80 wherein rinse material, such as water, is again sprayed onto the material. Each compartment includes a housing 90 having an entrance gateway 92 and an exit gateway defined therein with the exit gateway of one compartment forming the entrance gateway for the next succeeding compartment. Each compartment will be discussed in turn.

The pre-rinse, post-rinse and final rinse compartments are shown in FIGS. 1A, 2, 7 and 8. Each of the compartments includes a spray system 100 located downstream of the entrance gateway. Material thickness and pickling removal rates are controlled by a control system which incorporates an ultrasonic gauging system. Transducers 102 are located immediately downstream of the spray units in the rinse compartments to measure the incoming and outgoing material thickness at selected intervals across the material width. Material thickness can be controlled by coordinating the travel speed of the material with the ultrasonic thickness indicator. Preferably, there are three transducers 102 at each location. The transducers are preferably located to be at the top of a strip, at the middle of a strip, and near the bottom of a strip. The transducer readout is displayed on a console near an operator station, or at another convenient location.

Each of the compartments has a drive roll unit 104 located downstream of the spray system. As shown in FIG. 1A, the elements of the pre-rinse unit are located closer together than those elements of the final rinse unit. A drain 110 is located in each unit, and is connected to a main drain line 112. A water jacket surrounds each thickness gauge in the preferred embodiment.

Figure 7:
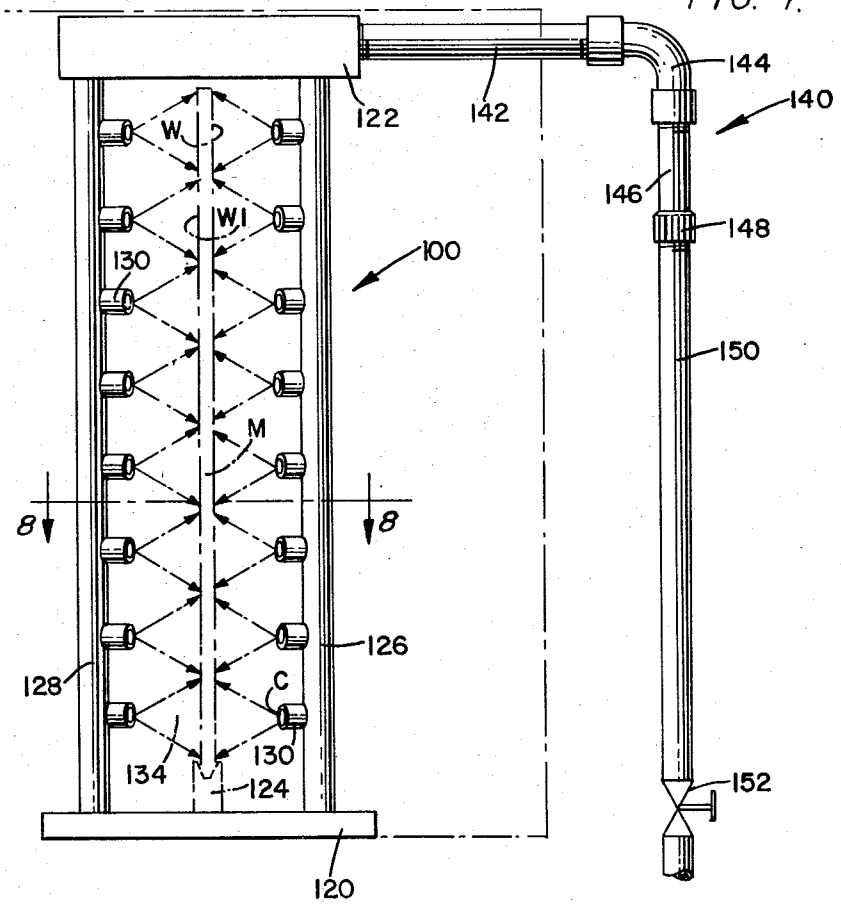
FIG. 7 is a view taken along line 7—7 of FIG. 2.
Figure 8:
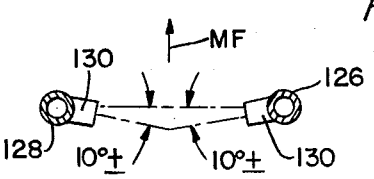
FIG. 8 is a view taken along line 8—8 of FIG. 7.

As best shown in FIGS. 7 and 8, the spray systems 100 are vertically oriented and the material passes through the systems with the widthwise faces thereof facing outwardly as indicated in FIG. 7 for faces W and W1. The spray systems include a base 120 and a top header 122 which is vertically spaced from the base a distance sufficient to permit free passage of the material M therebetween while that material is supported on guide rolls 124.

The spray system includes a pair of spaced vertical supply pipes 126 and 128 mounted at the lower ends thereof on the base 120 and fluidly connected at the upper ends thereof to the supply header 122. The supply pipes are located to be on opposite sides of the material passing through the compartment so that spray will be directed onto both widthwise faces of that material.

A plurality of spray nozzles 130 are mounted on each supply pipe to be vertically spaced apart and to be paired, that is, each nozzle on pipe 126 has a corresponding nozzle on pipe 128 located at the same vertical location. The nozzles are angled with respect to the material widthwise faces as shown in FIGS. 7 and 8 and define spray patterns 134 which, in toto, cover both widthwise faces of the material. In the preferred embodiment, the paired nozzles are angled with respect to the material flow path to define an angle of about 80 degrees therewith, that is, about 10 degrees with respect to a straight line connecting two paired nozzles as shown in FIG. 8. The preferred embodiment of the nozzles define a 120 degree cone of spray. The nozzles are angled to face upstream as indicated in FIG. 8 where the material flow direction is indicated by the arrow MF.

A header supply pipe 140 includes a first horizontal section 142 coupled to an ell 144 which is coupled to a nipple 146. The nipple includes a quick-disconnect 148 coupling that nipple to a first vertical section 150 which includes a globe valve 152. The vertical section 150 is connected to a main supply line 156 as shown in FIG. 1B.

The acid spray compartments are shown in FIGS. 1B and 3–5. Each compartment includes a guide roller system 160 located immediately upstream of the exit gateway and which includes a pair of vertically oriented guide rollers located on each side of the material flow path. Each compartment includes an acid spray system 164 located immediately upstream of the guide rollers, and a drain 166 located upstream of the spray system. The drains are connected by quick disconnects 168 to valves 170 which are used to connect the drain either to an acid return line, such as line 172 in FIG. 3, or to the water drain line 112. The drains will be more fully discussed below. Rinse water spray units 176 are located in each compartment, and are fluidly connected to the rinse water supply line 156.

Figure 3:
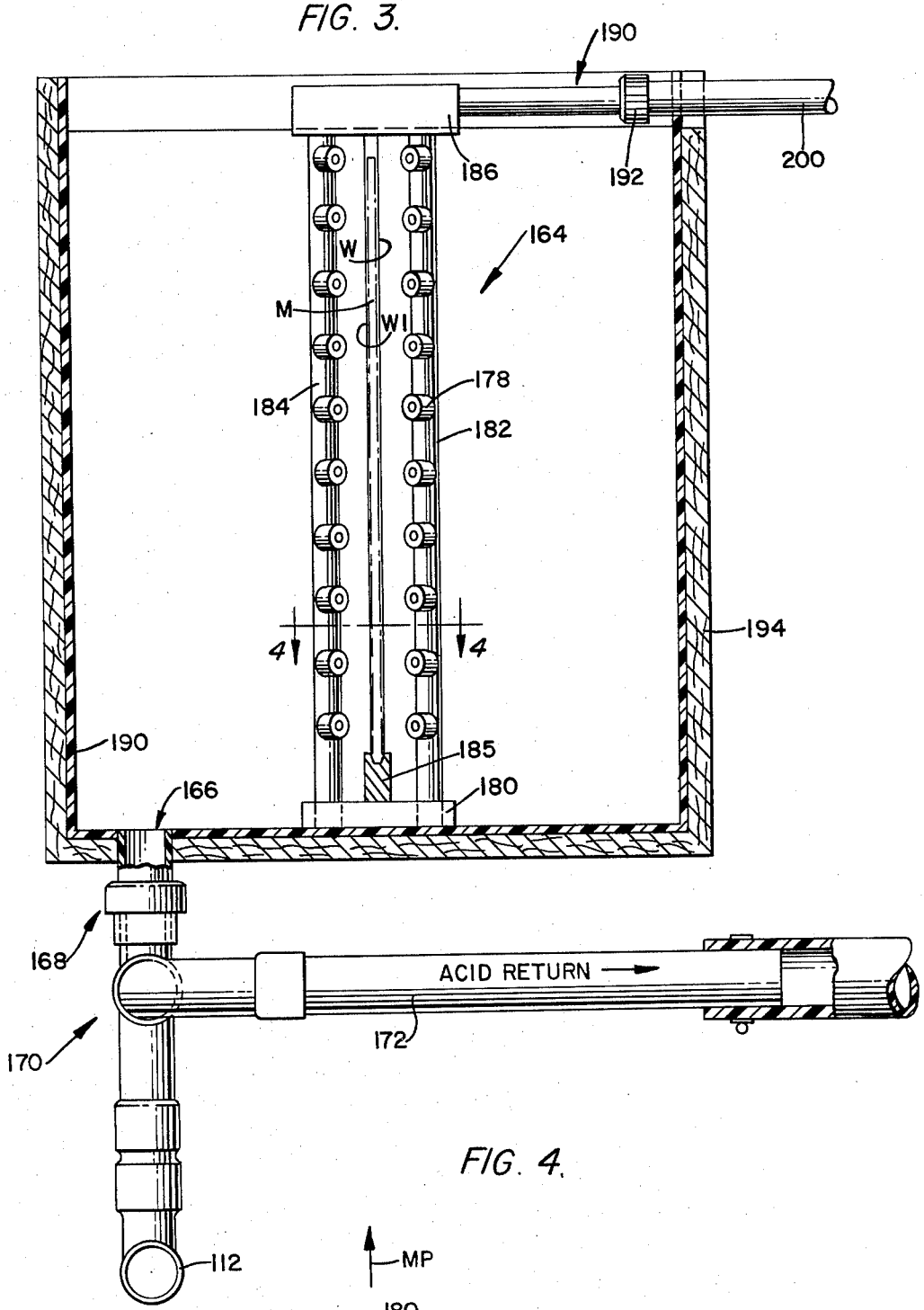
FIG. 3 is a view taken along line 3—3 of FIG. 2.

The acid spray systems 164 are similar to the water spray systems 100, and include one gallon per minute nozzles 178 (more or less, depending on requirements), whereas the water spray nozzles preferably generate two gallons per minute. An acid spray system is shown in FIG. 3 to include a base 180 mounted on the bottom of a compartment, and a pair of vertically oriented nozzle supply pipes 182 and 184 mounted on the base to extend upwardly therefrom on each side of the material M moving on roller 185 through the compartment. The solid lines on the material M represent pre-pickled thickness, whereas the phantom lines represent post-pickle material thickness. The supply pipes are connected to a supply header 186 located at the top of the compartment. The supply header is fluidly connected to an acid tank by a connecting line 190 which includes a coupling 192 therein. Tank housing 195 is preferably a material such as polypropylene.

Figure 4:
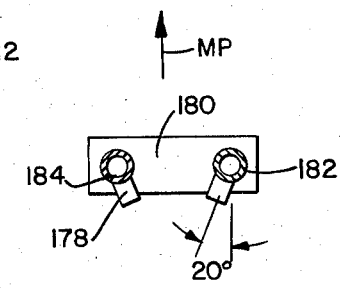
FIG. 4 is a view taken along line 4—4 of FIG. 3.

The spray nozzles 178 are vertically spaced and are in pairs and, as shown in FIG. 4, are oriented so that each nozzle faces upstream at an angle of about 20 degrees with respect to the material flow direction as indicated by arrow MF in FIG. 4, and therefore direct spray in the upstream direction.

Figure 11:
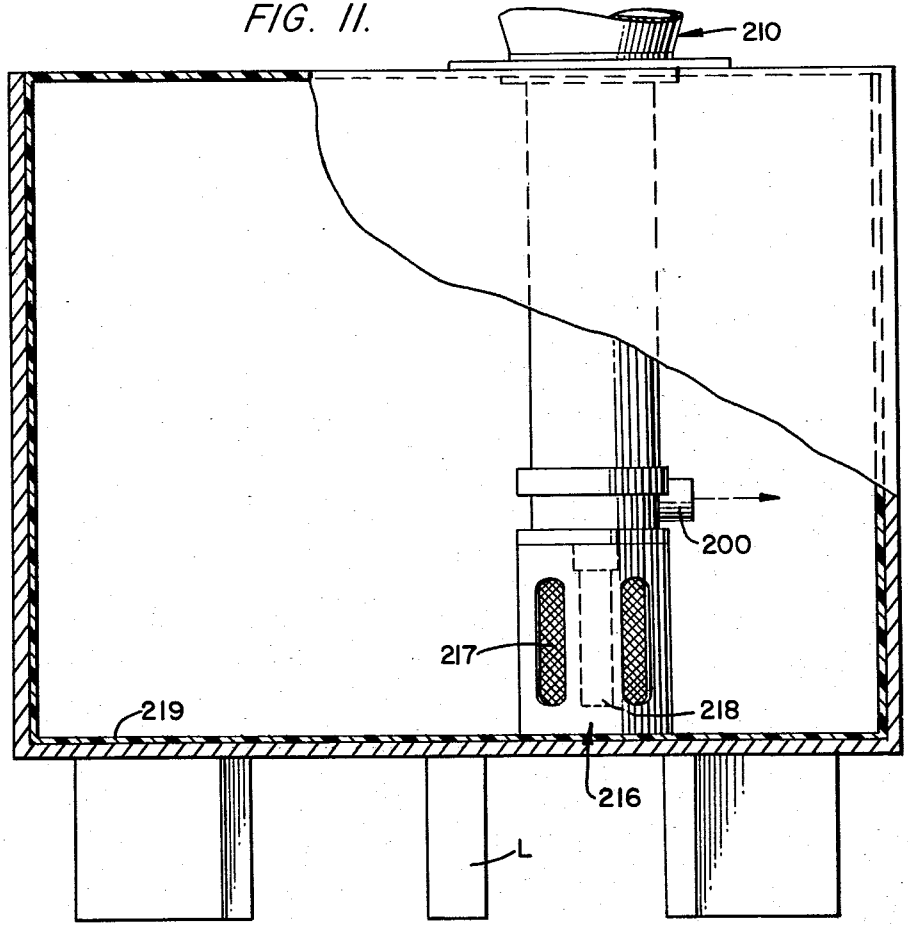
FIG. 11 is a view taken along line 11—11 of FIG. 1A.

Each compartment has a liner 196, and has an acid tank associated therewith. Thus, as shown in FIG. 1B, the acid tanks 197, 198 and 199 are each associated with acid compartments 72, 74 and 76, respectively. Each tank is fluidly connected to a compartment via acid supply lines 200, and acid return lines, such as line 172 shown in FIG. 3. The acid lines all include valves 204 which are controlled to be open and closed at the appropriate times. The control can be automatic or manual. Each acid tank includes a pump unit 210 which includes a motor 212 and a heating unit 214 for maintaining the acid at the desired temperature. As shown in FIG. 11, the pumps have intake systems 216 located in the tanks and have a filter screen 217 located therein. An intake line 218 is fluidly connected with the acid supply line 200. Each tank can include a special liner 219 therein, and rests on a plurality of legs L. An acid reclaim system is associated with each tank and is fluidly connected thereto via acid reclaim lines 220 having valves 224 therein. A rinse system is also associated with each tank and is fluidly connected thereto by a rinse water line 226 having a shutoff valve 228 therein. The heating unit can include means for controlling the temperature of the acid by circulating water through a water circulation system in the tank, with the water being at an appropriate temperature. The water circulation system will, of course, be in heat transfer contact with the acid in the tank at a location most suitable for controlling the temperature of the acid in the tank.

Figure 5:
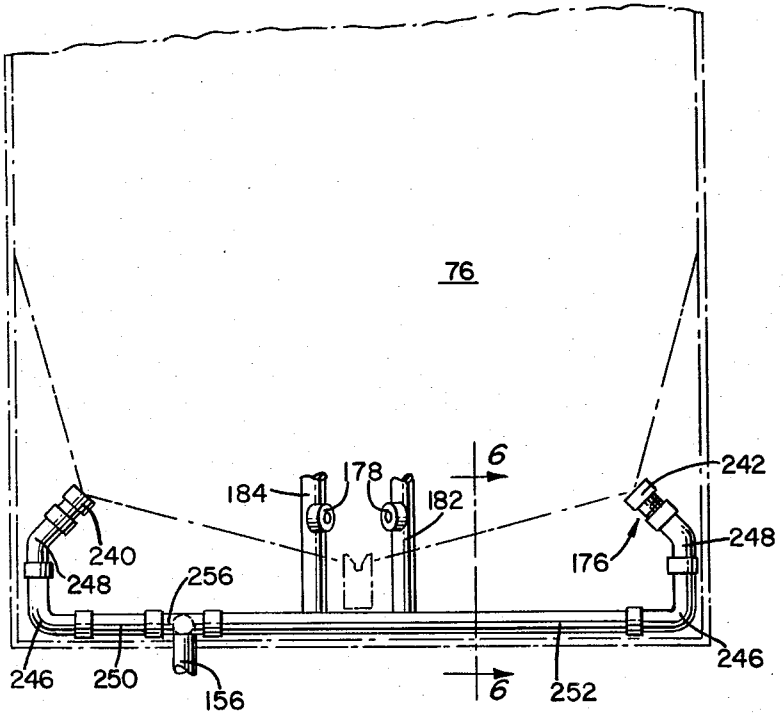
FIG. 5 is a view taken along line 5—5 of FIG. 2.
Figure 6:
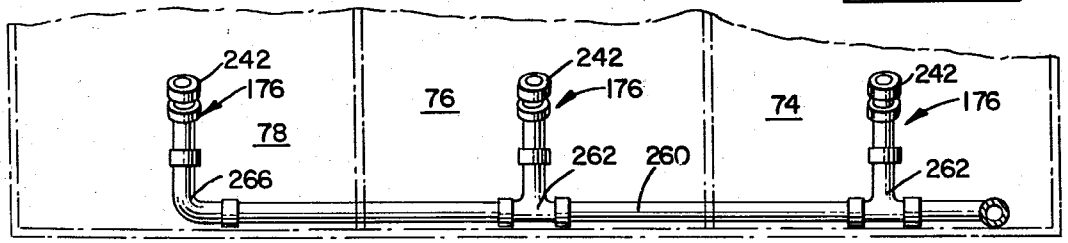
FIG. 6 is a view taken along line 6—6 of FIG. 5.

The acid compartments can be water rinsed when necessary using the water spray units 176. The rinse water spray units 176 are best shown in FIGS. 1A, 5 and 6. Each compartment includes a pair of rinse water nozzles 240 and 242 located near the bottom of the compartment, and each nozzle is located on one side of the material flow path through the compartment. Each nozzle is preferably a two gallon per minute nozzle and is fluidly attached to an ell 246 by a coupling 248, and produces the spray pattern indicated in phantom lines in FIG. 5. The ells are each fluidly attached to nipples 250 and 252 which, in compartment 76, are connected to a tee coupling 256. The tee coupling is fluidly coupled to rinse water supply line 156, and water can be sprayed into the acid compartment when desired. As shown in FIG. 6, the rinse nozzles on each side of the material flow path are fluidly interconnected by coupling lines 260 and tees 262. The tee is replaced by an ell 266 in compartment 78, and the tee coupling 262 is located in the compartment 76. Thus, water from the water supply is supplied to the nozzles 240 and 242 in each compartment via tee coupling 256 and the interconnecting nipples and tees 262.

When acid compartments are being water rinsed, the valve 170 is positioned to fluidly connect the acid compartment drains 166 to the water drain line 112. When the acid compartments are being used to spray acid onto a strip of material, the valve 170 is positioned to fluidly connect the drains 166 to the acid return lines 172. Safety systems can be used to ensure that the acid sprays cannot be turned on if the valve 170 is not associated with the acid return line, and vice versa for the water system.

Figure 9:
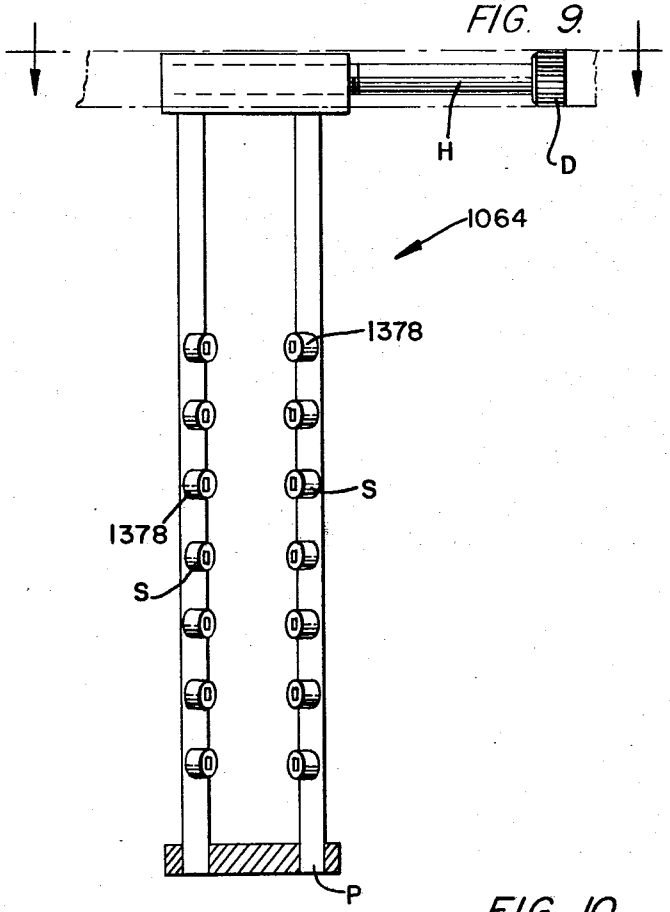
FIG. 9 is an elevation view of an alternative form of the spray system shown in FIG. 7.
Figure 10:
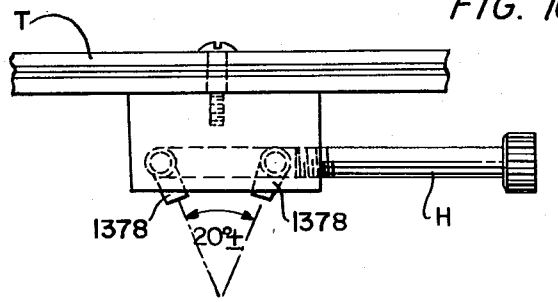
FIG. 10 is a view taken along line 10—10 of FIG. 9.

An alternative form of spray units is shown in FIGS. 9 and 10 as unit 1064. The spray unit 1064 in these figures is used for either water or acid spray similar to units 100 or 164 previously discussed. The unit 1064 has a plurality of nozzles 1378 mounted on supply pipes similar to the nozzles 130 and 178 previously discussed. However, the unit 1064 is used with materials having smaller width dimensions than the units 100 and 164. Thus, for example, the unit 164 is used with 24 inch width material; whereas unit 1064 is used with material which is 18 inches in width. The nozzles 1378 are paired to define an included angle of about 20 degrees as shown in FIG. 10.

The nozzles 1378 are shown with rectangular openings S as opposed to circular openings C for nozzles 130 and 178; however, the nozzles 130, 178 and 1378 can have circular openings if so desired. An end plug P must be included with unit 1064 and with the units 100 and 164 to occlude the supply pipe lower ends. A quick-disconnect coupling D connects the supply header H of the unit 1064 to the appropriate supply line.

As shown in FIG. 1A, an air knife unit 300 is located immediately downstream of final rinse compartment 80. The air knife unit quickly and uniformly dries the material passing therethrough and thereby prevents water spotting or staining of that material. The air knife unit includes a housing 302 having an entrance gateway 304 and an exit gateway 306 defined therein. A plurality of paired tubular air knives 310 are located to be on opposite sides of the material exiting compartment 80.

As shown in FIG. 2, flexible exhaust tubes 312 and 314 are fluidly connected to the spray section 12 and to the air knife 310, respectively, for conducting gaseous material such as fumes, or the like, away from the system 10 to a suitable storage or disposal means (not shown).

A control unit 320 includes control switches for the power drive rolls, and the like.

An exit power drive assembly 322 is located immediately downstream of the air knife 300 as best shown in FIGS. 1A and 2. The exit power drive assembly is similar to power drive assembly 50 and includes a housing 323 and a mounting platform 324 on which is mounted a motor 326 and a drive roll assembly 328. The drive roll assembly includes a pair of drive rolls 329 located on each side of the material flow path as shown in FIG. 1A.

An exit apron 330 is located downstream of the control unit and is used in conjunction with strip materials having prescribed lengths. The exit apron includes a material conveying system 332 and a pneumatic downender, or unloader 334. A plurality of guide rolls 336 and 338 are included in the exit apron assembly. The unloader 334 is similar to loader 16 and reorients material from an upright orientation into a recumbent orientation with the widthwise faces of that material oriented essentially horizontally.

A hydraulically operated vertical coiler unit, or material takeup unit 350, is located adjacent the exit apron 330. The coiler is used with continuous strip material, whereas apron 330 is used with material in strips of defined lengths.

In the preferred embodiment, the acid spray units are comprised of quick-disconnect U-shaped CPVC pipe, and the spray nozzle assemblies are mounted on polypropylene manifold brackets to be located in separate compartments. The compartments of the preferred embodiment are sealed by squeegee rolls and double wipers within the spray section. The compartments of the preferred embodiment are independently fed through CPVC pipes by polypropylene submersible two horsepower pumps located in a cylindrical polypropylene fiberglass tank. The preferred tank includes a pressurized polypropylene tube having thermostatically regulated cooling water circulating therethrough and which is coiled about the tank for controlling the acid temperature to about plus or minus 2° F.

The spray pickling process is best understood by referring to FIGS. 1A and 1B. Material, such as Zircaloy, is loaded onto the apron 14 and turned upright so that the widthwise faces thereof are oriented to extend vertically. If the Zircaloy is to be used from coils, the vertically oriented, uncoiler 44 is used. The material is fed into the power drive assembly 50 which then feeds the material into the spray section 12. The material is pre-rinsed with water in compartment 70, then the thickness thereof gauged by transducers 102, then fed through a gateway into the first acid spray unit 72 and sprayed with pickling acid from spray system 164. The material is then fed into second acid spray unit 74 and third acid spray unit 76 to be sprayed with pickling acid again in each compartment. The material is then fed into post-rinse compartment 78 and then into final rinse compartment 80 to be washed with water, and the thickness thereof again gauged by transducers 102. The material is then dried in the air knife unit, then passed onto the unloading apron. If continuous strip material is being pickled, the material is coiled onto the take-up coil 350; or if strips of discrete lengths are being pickled, the material is fed onto unloading apron 330 and reoriented into a widthwise, face up orientation.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

We claim:

1. A process of spray pickling strip material to produce an even surface finish comprising steps of:

orienting a strip of material to have the two widthwise faces thereof in an essentially upright position;

moving said strip of material in a straight line at an essentially constant rate which rate falls in a range of between 0–30 feet per minute along the length dimension of such strip;

wiping said material strip;

spraying water at an angle of about 10 degrees from normal with respect to the material upright faces to pre-rinse both said wiped faces with water;

ultrasonically gauging the thickness of the pre-rinsed strip material;

spraying pickling acid onto both said pre-rinsed upright faces at an angle of about 20 degrees with respect to the material upright faces, said acid spraying step including three successive treatments with acid comprising spraying acid a first time onto said upright faces, removing at least some of said pickling acid from said faces by simultaneously wiping both said faces immediately after said acid spraying step, spraying acid a second time onto both said wiped faces, removing at least some of said pickling acid from both said faces by simultaneously wiping both said faces immediately after said second acid spraying step, spraying acid a third time onto both said wiped faces, and removing at least some of said pickling acid from both said faces by simultaneously wiping both said faces immediately after said third acid spraying step;

performing a post-rinse to remove acid from both said faces by spraying both said upright faces with water after wiping said acid therefrom in the last-mentioned wiping step, said spraying occurring as soon as possible after the last wiping step so that post-rinse of said strip occurs with essentially no exposure thereof to air between acid application and water rinse;

ultrasonically gauging the thickness of the strip material after said post-rinse spraying step;

drying said post-rinsed upright faces with air, said drying occurring quickly and uniformly to essentially prevent water spotting of the strip;

tensioning said strip material so that straight line passage through said rinsing, pickling and drying steps is maintained; and storing the material after said drying step.

2. The process defined in claim 1 further including a step of wiping said pre-rinsed faces prior to said first acid spraying step.

3. The process defined in claim 1 further including a step of heating the acid prior to spraying the acid onto the upright strip material.

4. The process defined in claim 1 further including a step of water rinsing compartments wherein said acid spraying steps are performed.

5. The process defined in claim 1 wherein said pre-rinsing step and said post-rinsing step further include spraying water at the strip material with nozzles angled to face upstream of material movement.

6. The process defined in claim 1 further including a final rinse step of spraying water onto said post-rinsed upright faces prior to said drying step.

7. The process defined in claim 1 wherein each of said acid spraying steps includes spraying acid at the strip material with nozzles angled to face upstream of material movement.

8. The process defined in claim 1 wherein the spraying steps use nozzles with circular openings.

9. The process defined in claim 1 wherein the strip material is zirconium.

10. The process defined in claim 1 further including storing the pickled material on a coiler.

* * * * *